US005361934A

United States Patent [19]

Spence, Jr.

[11] Patent Number: 5,361,934

[45] Date of Patent: Nov. 8, 1994

[54] POP-UP STRAW FOR JUVENILE DRINKING CUP

[75] Inventor: Meredith Spence, Jr., Roswell, Ga.

[73] Assignee: Lisco, Inc., Tampa, Fla.

[21] Appl. No.: 226,587

[22] Filed: Apr. 12, 1994

[51] Int. Cl.[5] ..... B65D 47/06

[52] U.S. Cl. ..... 220/707; 220/709; 220/719; 215/1 A

[58] Field of Search ..... 220/705, 707, 708, 709, 220/714, 713, 717, 719; 215/1 A

[56] References Cited

U.S. PATENT DOCUMENTS

| | | | |
|---|---|---|---|
| 2,622,415 | 12/1952 | Landers et al. | 62/142 |
| 2,724,536 | 11/1955 | Pugh, Sr. | 215/1 A |
| 2,844,267 | 7/1958 | Petriccione | 215/100 |
| 3,132,776 | 5/1964 | Wasserberg | 220/708 |
| 4,252,256 | 2/1981 | Walsh | 222/211 |
| 4,448,316 | 5/1984 | Hiroshige | 215/1 A |
| 4,684,032 | 8/1987 | Tsay | 215/1 A |
| 4,699,318 | 10/1987 | Donatello et al. | 215/1 A |
| 4,726,479 | 2/1988 | Tsai | 215/229 |
| 4,852,762 | 8/1989 | Chou-Sheng | 220/90.2 |
| 4,941,590 | 7/1990 | Pantaleo et al. | 220/428 |
| 5,109,995 | 5/1992 | Lou | 215/1 A |
| 5,150,815 | 9/1992 | Saklad | 220/708 |
| 5,167,354 | 12/1992 | Cohanfard | 224/148 |
| 5,234,117 | 8/1993 | Garvin | 220/709 |
| 5,265,757 | 11/1993 | Wu | 220/707 |
| 5,273,172 | 12/1993 | Rossbach et al. | 220/707 |
| 5,282,541 | 2/1994 | Chen | 220/709 |

*Primary Examiner*—S. Castellano

*Attorney, Agent, or Firm*—Donald R. Bahr; John E. Benoit

[57] ABSTRACT

A pop-up straw closure for liquid containers comprising a lid having an upper wall and circular side wall adapted to be threaded on the liquid container. The upper wall includes an upstanding hollow cylinder within which is held a flexible straw extending above and below the lid. A dome is rotatably secured to the lid and includes an elongated orifice. The upper end of the straw extends through the orifice when mated therewith and is folded by the dome when not mated with the orifice. When in use, a further straw is inserted in the lower section of the flexible straw such that it extends into the liquid container.

8 Claims, 3 Drawing Sheets

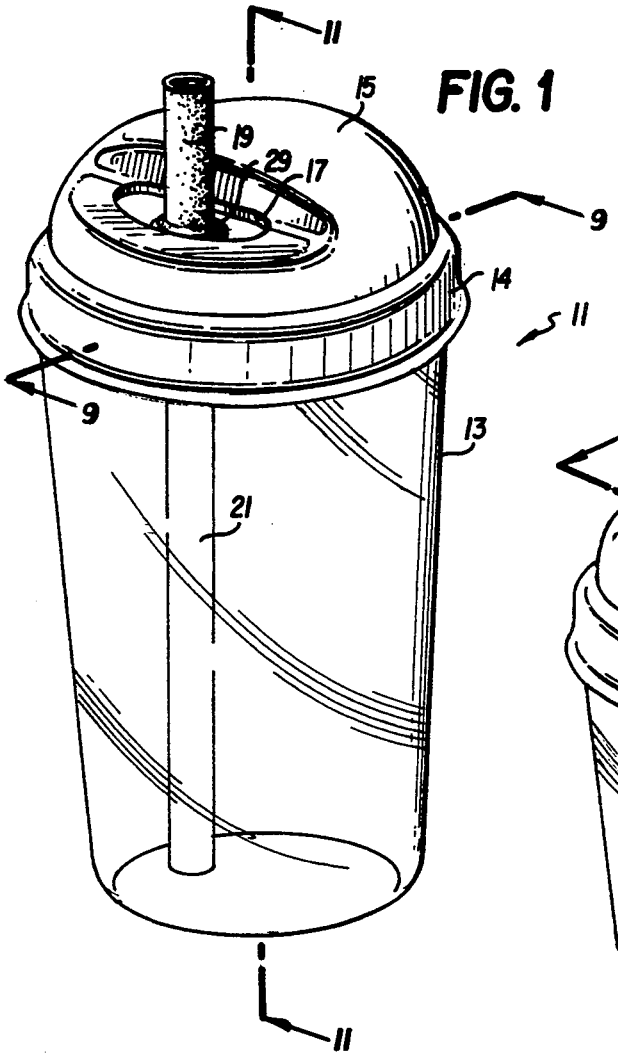
FIG. 1
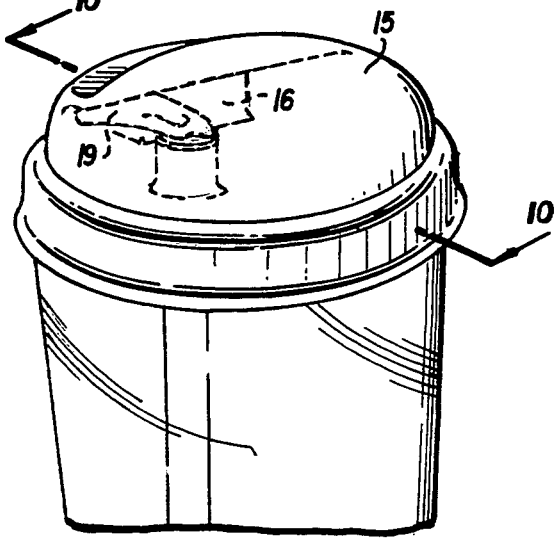
FIG. 2
FIG. 10
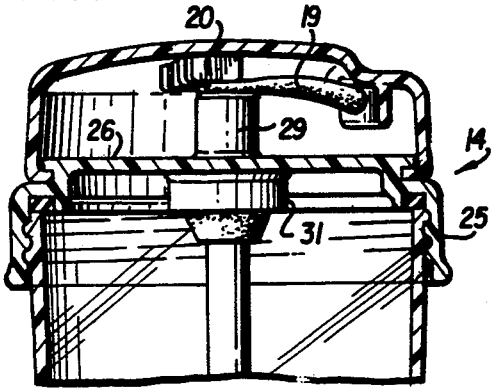
FIG. 9
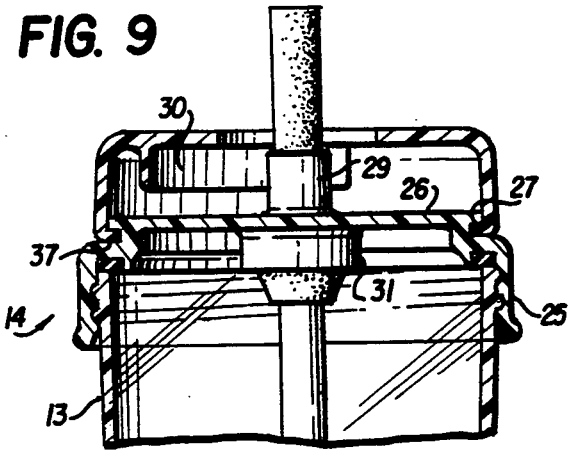

FIG. 4
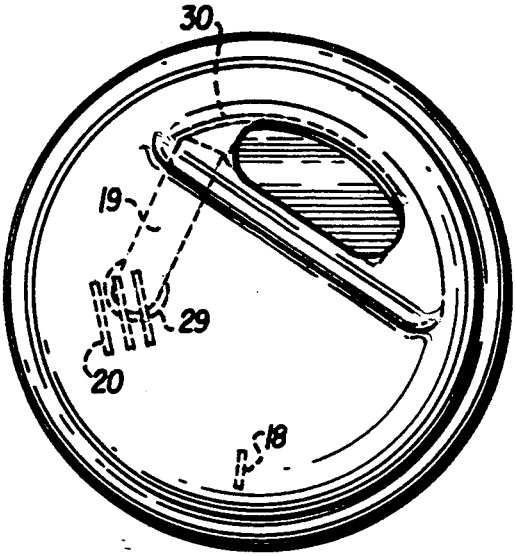
FIG. 3
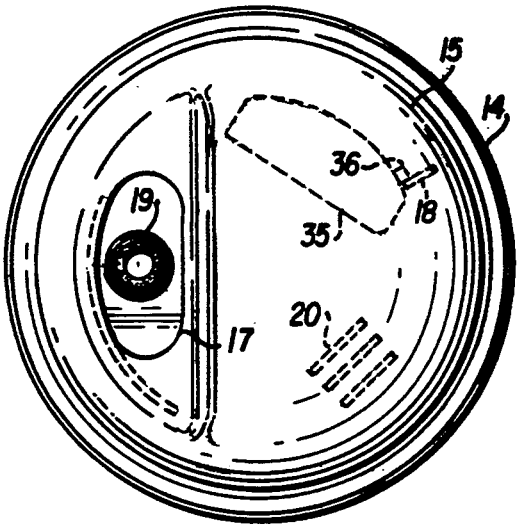
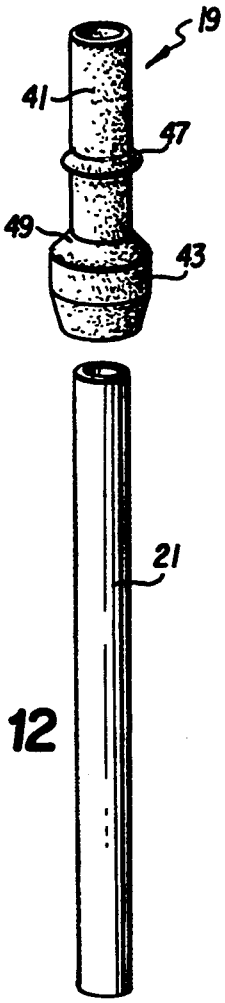
FIG. 12
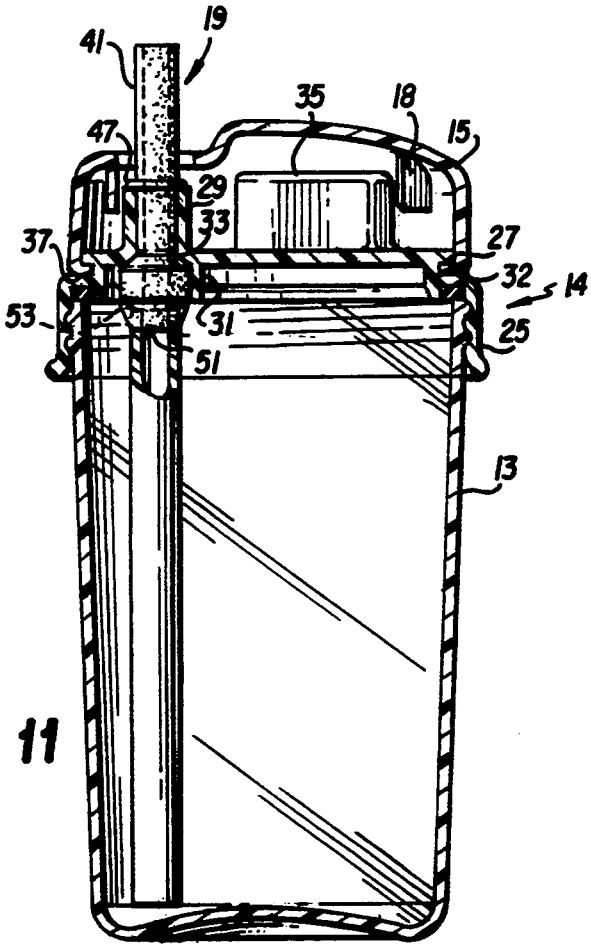
FIG. 11

POP-UP STRAW FOR JUVENILE DRINKING CUP

This application relates to drink containers in general and more particularly to a juvenile drink container which includes a pop-up straw feature.

Juvenile drinking cups are well known and come in a variety of configurations, including cap configurations. Some cups have been manufactured which use a two-piece cover in the form of a lid detachable from the drink container itself and a cap rotatably mounted on the lid. In those configurations of which I am aware, the lid contains some means for holding a straw which extends upwardly from the lid. These means usually include some type of locknut arrangement for holding a straw which extends through an orifice in the cap, allowing the straw to extend outwardly from the cap in one position and to be folded down in another position.

The present invention relates to a pop-up straw configuration wherein the upper straw is a unitary member made of flexible and compressible material which may be inserted into a lid and which secures itself within the lid in a sealing fashion. A second straw is inserted into the lower section so that the second straw extends into the container.

SUMMARY OF THE INVENTION

The present invention provides a pop-up straw closure for a container comprising a lid having an upper wall and a circular side wall adapted to be threaded on a liquid container. The upper wall includes an upstanding hollow cylinder within which is held a unitary flexible and compressible straw extending above and below the lid. A dome is rotatably secured to the lid and includes an elongated orifice. In the use position the upper end of the straw extends through the orifice when mated therewith and in the non-use position is folded within the dome when not mated with the orifice. A subtending member in the dome bears against the folded straw in the non-use position so as to prevent leakage of liquid through the straw. When in use, a further straw is inserted into the lower section of the flexible straw such that it extends into the liquid container.

BRIEF DESCRIPTION OF THE DRAWINGS

FIG. 1 is a perspective view of a container with the cup lid and cap mounted on the liquid holder in a use position;

FIG. 2 is a partial view of FIG. 1 showing the cap rotated so as to fold the straw in a non-use position;

FIG. 3 is a top view of FIG. 1;

FIG. 4 is a top view of FIG. 2;

FIG. 9 is a partial sectional view taken through the lines 9—9 of FIG. 1;

FIG. 10 is a partial sectional view taken through lines 10—10 of FIG. 2;

FIG. 11 is a view taken through the lines 10—10 of FIG. 2 with the cap rotated and the straw in a folded position; and FIG. 12 is an exploded view of the upper and lower straws as shown in FIG. 1.

DETAILED DESCRIPTION OF THE PREFERRED EMBODIMENT

Figure 5:
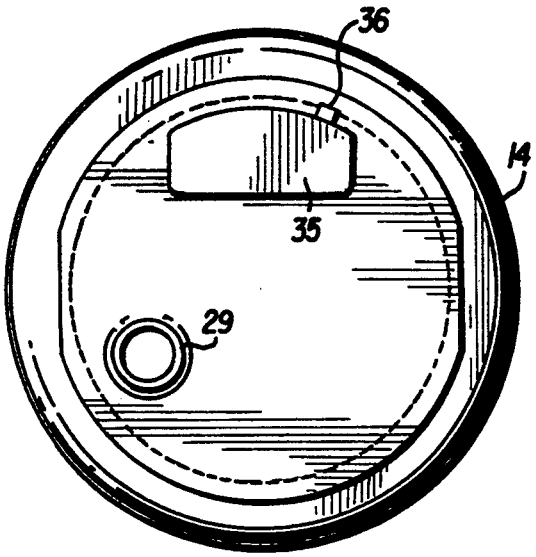
FIG. 5 is a bottom view of the lid of FIG. 1.

Referring to FIG. 1, there is shown drink container 11 which includes cylindrical liquid reservoir 13, a cover which consists of lid 14 and domed cap 15, with the domed cap having elongated aperture 17 through which upper straw 19 extends. Also shown is lower straw 21, which may be inserted into the bottom portion of cylinder 29. Domed cap 15 is attached to lid 14 so that it may be rotated relative thereto. In the position shown in FIG. 1, aperture 17 is configured so as to mate with upper straw 19 and allow the straw to protrude through the aperture.

Upper straw 19 is made of a flexible and compressible material such as silicone; accordingly, when domed cap 15 is rotated to a position as shown in FIG. 2, upper straw 19 is folded downwardly and held in place in that position by the cap and sealed by subtending member 16. This not only folds the straw, but effectively seals it so that liquid from reservoir 13 cannot leak outwardly from the straw.

FIGS. 3 and 4 are top views of FIGS. 1 and 2, respectively. Again, FIG. 3 shows upper straw 19 extending outwardly from aperture 17 in domed cap 15. FIG. 4 shows the straw folded with aperture 17 being rotated to a new position. In this position an upwardly extending island 35, which will be described more thoroughly, mates with aperture 17, effectively closing the aperture when the straw is folded in its non-use position.

With reference to FIG. 5, lid 14 includes upstanding island 35 with outwardly extending finger 36, cylinder 29, and arcuate flange 30. Details of the mating structure of the liquid reservoir, lid, and cap will be discussed relative to FIG. 10.

Figure 6:
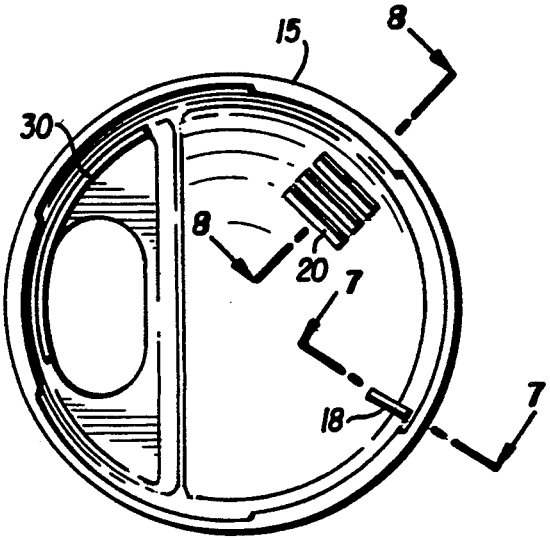
FIG. 6 is a bottom view of the cap of FIG. 1.
Figure 7:
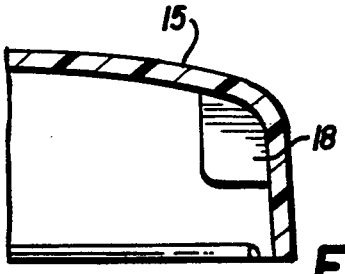
FIG. 7 is a partial sectional view taken through the lines 7—7 of FIG. 6.
Figure 8:
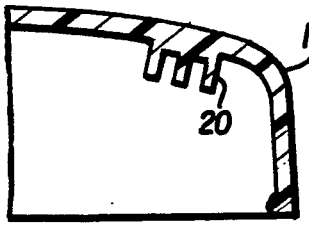
FIG. 8 is a partial sectional view taken through the lines 8—8 of FIG. 6.

Referring to FIGS. 6, 7, and 8, cap 15 includes aperture 17, plate 18, and depending sealing member 20. The lid and cap are preferably formed as single molded units.

FIG. 3 shows the cap and lid in a use position wherein straw 19 extends outwardly from aperture 17. In this position plate 18 abuts against finger 36 so as to limit rotation of the cap in the counterclockwise direction.

FIG. 4 shows the cap and lid in the non-use position wherein aperture 17 is substantially centered above island 35 and straw 19 is folded beneath cap 15. When cap 15 is rotated to the position shown, arcuate flange 30 abuts against finger 36 so as to limit the clockwise rotation of the cap. In this non-use position sealing member 10 presses down on folded straw 19 above cylinder 29, effectively sealing the straw so as to prevent leakage of liquid from reservoir 13.

Turning to FIGS. 9, 10, and 11, there is shown in more detail the relationship of lid 14 and domed cap 15. Lid 14 includes circular wall 25, which is internally threaded so as to mate with the external threading at the upper part of reservoir 13. Upper wall 26 of lid 14 extends across the major part of the opening above the reservoir and includes peripheral channel 27.

Upper wall 26 also includes hollow cylinder member 29, which extends upwardly from the wall. Circular flange 31 subtends from wall 26 below circular member 29 and both the flange and the circular member have a substantially identical axis. Flange 31 and circular member 29 are interconnected by convex wall 33.

Domed cap 15 is semi-flexible and terminates in inward extending lip 37 at its mouth. Accordingly, cap 15 can be placed on lid 14 by a snap action so that lip 37 fits within circular channel 27 in the lid structure.

The structure as shown in FIG. 9 also includes upwardly extending island 35, which is located so that it effectively covers the longitudinal orifice 17 when cap 15 is rotated to the position wherein the straw is folded, thus maintaining a more sanitary condition when the drinking cup is not being used. Additionally, silicone seal 32 is used so as to prevent any leakage of liquid between reservoir 13 and lid 14.

Referring now specifically to FIGS. 11 and 12, there is shown the construction of upper straw 19. The upper straw includes upper hollow cylindrical section 41 and lower section 43. Sections 41 and 43 are connected by concave shoulder 49, which mates with convex wall 33 of lid 14. The outside diameter of section 43 is larger than the outside diameter of section 41 so that the straw may be inserted into the underside of the lid and pushed upwardly until concave shoulder 49 mates with convex surface 33. In order to further ensure a proper liquid seal, upper cylindrical section 41 may include circular rib member 47 extending outwardly therefrom and resting adjacent the upper end of cylindrical member 29. Because of the silicone nature of the straw, rib 47 is compressed as it passes through cylinder member 29 and then returns to its normal configuration as shown in FIG. 12.

Straw 21 is of a size to mate with opening 51 in lower section 43 of upper straw 19 and abuts against shoulder 53 so that it is held firmly in place. Preferably the straw is made of a polyethylene material and can be removed for cleaning and reinserted as shown.

The above description and associated drawings are illustrative only since various components could be modified without departing from the invention, the scope of which is to be limited only by the following claims.

I claim:

1. A removable closure for a drinking cup comprising
- a lid removably attached to a cylindrical open-mouthed liquid container;
- a hollow cylindrical member extending upwardly from said lid;
- a circular flange depending downwardly from said lid, said circular flange and said cylindrical member having a common axis, the internal diameter of said circular flange being greater than the internal diameter of said cylindrical member;
- a flexible and compressible, one piece straw comprising
  - an upper section fitting within and extending outwardly from said cylindrical member;
  - a lower section fitting within and extending below said depending circular flange;
  - a rib member extending outwardly from said upper section, said rib being adjacent the distal end of said hollow cylindrical member;
- a cap rotatably mounted on and covering said lid; and
- an elongated opening in said cap adapted to mate with said upper section of said straw;
- whereby said upper section of said straw extends outwardly of said cap when mated with said opening and is folded when not mated with said opening.

2. The removable closure of claim 8 further comprising
- an upstanding member on the outer surface of said lid, said upstanding member being geometrically configured so as to substantially cover said elongated opening when said straw is folded.

3. The removable closure of claim 1 further comprising
- cooperating members on said cup lid and said dome for limiting the degree of rotation of said dome relative to said cup lid.

4. The removable closure of claim 1 further comprising
- a member depending from the interior of said cap and located so as to compress said straw against said hollow cylindrical member so as to seal said straw.

5. A removable closure for a drinking cup comprising
- a cup lid comprising
  - an internally threaded peripheral wall;
  - an upper wall integral with said peripheral wall;
  - a circular flange depending downwardly from said upper wall and spaced from said peripheral wall;
  - a watertight seal between said peripheral wall and said flange;
  - a peripheral channel between the outer extremities of said peripheral wall and said upper wall;
  - a hollow cylindrical member extending upwardly from said upper wall;
  - said circular flange and said cylindrical member having a common axis, the internal diameter of said circular flange being greater than the internal diameter of said cylindrical member;
  - a convex surface interconnecting the interior surfaces of said circular flange and said cylindrical member;
- a flexible straw comprising
  - an upper section having an outer diameter substantially the same as the internal diameter of said cylindrical member;
  - a lower section having an outer diameter substantially the same as the internal diameter of said cylindrical flange;
  - a concave shoulder interconnecting said upper and lower sections, said concave shoulder mating with said convex surface;
- a cap comprising
  - a semi-flexible dome terminating at its open end in an internally extending lip, said internal lip mating with said peripheral channel in said cup lid, whereby said dome is rotatable relative to said lid;
  - an elongated aperture in said dome adapted to mate with said upper section of said straw;
  - whereby said upper section of said straw extends outwardly of said dome when mated with said aperture and is folded when not mated with said aperture.

6. The removable closure of claim 1 wherein said cup lid further comprises
- an upstanding member on the outer surface of said upper wall spaced from said hollow cylindrical member, said upstanding member being geometrically configured so as to substantially cover said elongated opening when said upper section of said straw is folded.

7. The removable closure of claim 1 further comprising
- cooperating members on said cup lid and said dome for limiting the degree of rotation of said dome relative to said cup lid.

8. The removable closure of claim 1 further comprising a member depending from the interior of said cap and located so as to compress said straw against said hollow cylindrical member so as to seal said straw.

* * * * *

UNITED STATES PATENT AND TRADEMARK OFFICE

CERTIFICATE OF CORRECTION

PATENT NO. : 5,361,934

DATED : November 8, 1994

INVENTOR(S) : Meredith Spence, Jr.

It is certified that error appears in the above-identified patent and that said Letters Patent is hereby corrected as shown below:

Column 4:

CLAIM 6, LINE 1; delete "1" and insert therefor --5--.

CLAIM 7; delete "1" and insert therefor --5--.

CLAIM 8; delete "1" and insert therefor --5--.

Signed and Sealed this

Twenty-fourth Day of January, 1995

*Attest:*

Bruce Lehman

BRUCE LEHMAN

*Attesting Officer*

*Commissioner of Patents and Trademarks*